US006363832B1

(12) United States Patent
Francis

(10) Patent No.: US 6,363,832 B1
(45) Date of Patent: Apr. 2, 2002

(54) METHOD AND APPARATUS FOR MINIMIZING LOADER FRAME STRESS

(75) Inventor: John E. Francis, Raleigh, NC (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/598,873

(22) Filed: Jun. 21, 2000

(51) Int. Cl.[7] ..... F01B 25/04
(52) U.S. Cl. ..... 91/171
(58) Field of Search ..... 91/171

(56) References Cited

U.S. PATENT DOCUMENTS

| | | | | | |
|---|---|---|---|---|---|
| 2,764,869 | A | * | 10/1956 | Scherr | 91/171 |
| 3,039,513 | A | * | 6/1962 | Lasiewicz et al. | 91/171 |
| 3,241,458 | A | | 3/1966 | Goldie | |
| 3,262,740 | A | | 7/1966 | Stockwell | |
| 3,265,357 | A | | 8/1966 | Schilling | |
| 3,289,868 | A | | 12/1966 | Miller et al. | |
| 3,638,535 | A | * | 2/1972 | Ponter | 91/171 |
| 3,659,498 | A | | 5/1972 | Richardson | |
| 3,769,881 | A | | 11/1973 | Aoki | |
| 3,961,670 | A | | 6/1976 | Rivinius | |
| 4,657,443 | A | * | 4/1987 | Blumenthal | 91/171 |
| 4,679,489 | A | | 7/1987 | Jasinski et al. | |
| 5,065,844 | A | | 11/1991 | Hon | |
| 5,072,649 | A | * | 12/1991 | Laghi | 91/171 |
| 5,597,987 | A | | 1/1997 | Gilliland et al. | |
| 5,791,860 | A | | 8/1998 | Stockmann | |
| 6,189,432 | B1 | * | 2/2001 | Colarelli et al. | 91/171 |

FOREIGN PATENT DOCUMENTS

| | | | | |
|---|---|---|---|---|
| EP | 163430 | | 12/1985 | |
| EP | 241883 | | 10/1987 | |
| GB | 2319858 | | 6/1998 | |
| JP | 357114002 A | * | 7/1982 | 91/171 |

* cited by examiner

*Primary Examiner*—Edward K. Look
*Assistant Examiner*—Igor Kershteyn
(74) *Attorney, Agent, or Firm*—Hancock Estabrook, L.L.P.; Diana L. Charlton

(57) ABSTRACT

A method and apparatus for minimizing the loader frame stress induced by the twisting action which results from unequal travel in the actuators. The method includes the use of electro-hydraulics in conjunction with feedback from actuators displacement sensors. Each actuator is controlled by an individual control valve. The amount of extension of each actuator's piston is monitored. Control signals are sent to the control valves which control fluid flow to each actuator to maintain the actuators' piston extensions at the same amount.

14 Claims, 3 Drawing Sheets

METHOD AND APPARATUS FOR MINIMIZING LOADER FRAME STRESS

TECHNICAL FIELD

This invention relates generally to fluid operated machine controllers for loaders and, more, particularly, to a method for automatically controlling actuator operation to minimize frame stresses.

BACKGROUND ART

Various systems for controlling the operation of the lift actuators (e.g., lift cylinders) of a wheel loader or a backhoe loader are known. Typically, the controller enables a vehicle operator to control the lift of a working implement (e.g., a bucket) by way of a fluid operated system. The fluid operated system normally includes a pair of actuators, one of which acts upon each side of a frame to which the working implement is attached. The two actuators must be operated uniformly with respect to each other to avoid conditions such as the application of uneven forces to the frame, which can cause twisting or other structural damage to the frame. If these forces are sufficiently imbalanced, permanent damage or a hazardous condition will result. This problem may also occur when one actuator has partially or completely failed. In this circumstance, the failure of the actuator to function in the intended manner may not be detected until damage is done. One approach to controlling the operation of a plurality of actuators to produce uniform operation is to attempt to control the flow of fluid to each actuator so that this flow is approximately equal. This approach is flawed because it cannot compensate for a failed actuator, or an actuator which leaks fluid and hence requires that more fluid be delivered to produce the required operation.

Another method of assuring uniform operation involves the reinforcement of the frame structure by the addition of bracing and reinforcing mechanisms. This approach is also unsatisfactory because it adds significant weight to the frame structure, resulting in a decrease in the payload capability of the machine, and at the same time requiring upgrading of the frame control mechanisms so that these mechanisms can properly operate with the increased load. Thus, the expense of the vehicle is increased. At the same time, however, this approach does nothing to address problems resulting from malfunctions of the actuators. The present invention is directed to overcoming one or more of the problems or disadvantages associated with the prior art.

DISCLOSURE OF THE INVENTION

A first aspect of the present invention provides a controller for load manipulation of a device by a first actuator and a second actuator, said controller comprising: an input device for receiving a first displacement signal and a second displacement signal, said first displacement signal from a first displacement sensor, said first displacement sensor operationally attached to said first actuator, and said second displacement signal from a second displacement sensor, said second displacement sensor operationally attached to said second actuator; a comparator for comparing the first displacement signal and the second displacement signal to determine a maximum differential value; and an output device for providing a signal to adjust the first and second actuator to be within a predetermined range for the maximum differential value, thereby preventing damage to the device.

A second aspect of the present invention provides a control system comprising: at least two lift actuators; a control valve, operatively connected to each of said lift actuators; a displacement sensor, operatively connected to each of said actuators to determine the amount of travel of the pistons of said actuators; a controller for comparing outputs from the displacement sensors and for operating said control valves to adjust the amount of travel of said pistons in response to the outputs of the displacement sensors.

A third aspect of the present invention provides an earth working machine comprising: at least two lift actuators; a control valve, operatively connected to each of said lift actuators; a displacement sensor, operatively connected to each of said actuators to determine the amount of travel of the pistons of said actuators; a controller for comparing outputs from the displacement sensors and for operating said control valves to adjust the amount of travel of said pistons in response to the outputs of the displacement sensors.

A fourth aspect of the present invention provides a control method for an implement attached to a frame on an earth working machine with first and second fluid operated actuators being operatively connected to the frame, and first and second control valves being adapted to deliver pressurized fluid to the actuators, comprising the steps of: producing an implement move command signal in response to a position of a control lever; receiving the implement move command signal and responsively delivering an implement move control signal to the first and second valves to cause pressurized fluid flow to actuate the first and second actuators to move the implement; producing a first position signal indicative of the extension of the first actuator; producing a second position signal indicative of the extension of the second actuator; and receiving the first and second position signals, determining a magnitude of the difference between the relative positions of the first and second actuators, comparing the magnitude difference to a maximum differential value, and stopping the delivery of the implement move control signal in response to the magnitude difference being substantially equal to the maximum differential value, the maximum differential value representing the maximum imbalance that the frame can withstand without damage.

A fifth aspect of the present invention provides a method of controlling loader lift cylinders comprising: providing a machine control system operatively coupled to the lift cylinders, wherein the machine control system includes means for determining the amount of extension of each of the lift cylinders; comparing the amount of extension of each lift cylinder; and adjusting the amount of extension of each lift cylinder in response to the amount of extension that is detected.

The foregoing and other features and advantages of the invention will be apparent in the following more particular description of preferred embodiments of the invention.

BRIEF DESCRIPTION OF THE DRAWINGS

The preferred embodiments of this invention will be described in detail, with reference to the following figures, wherein like designations denote like elements, and wherein.

BEST MODE FOR CARRYING OUT THE INVENTION

Figure 3:
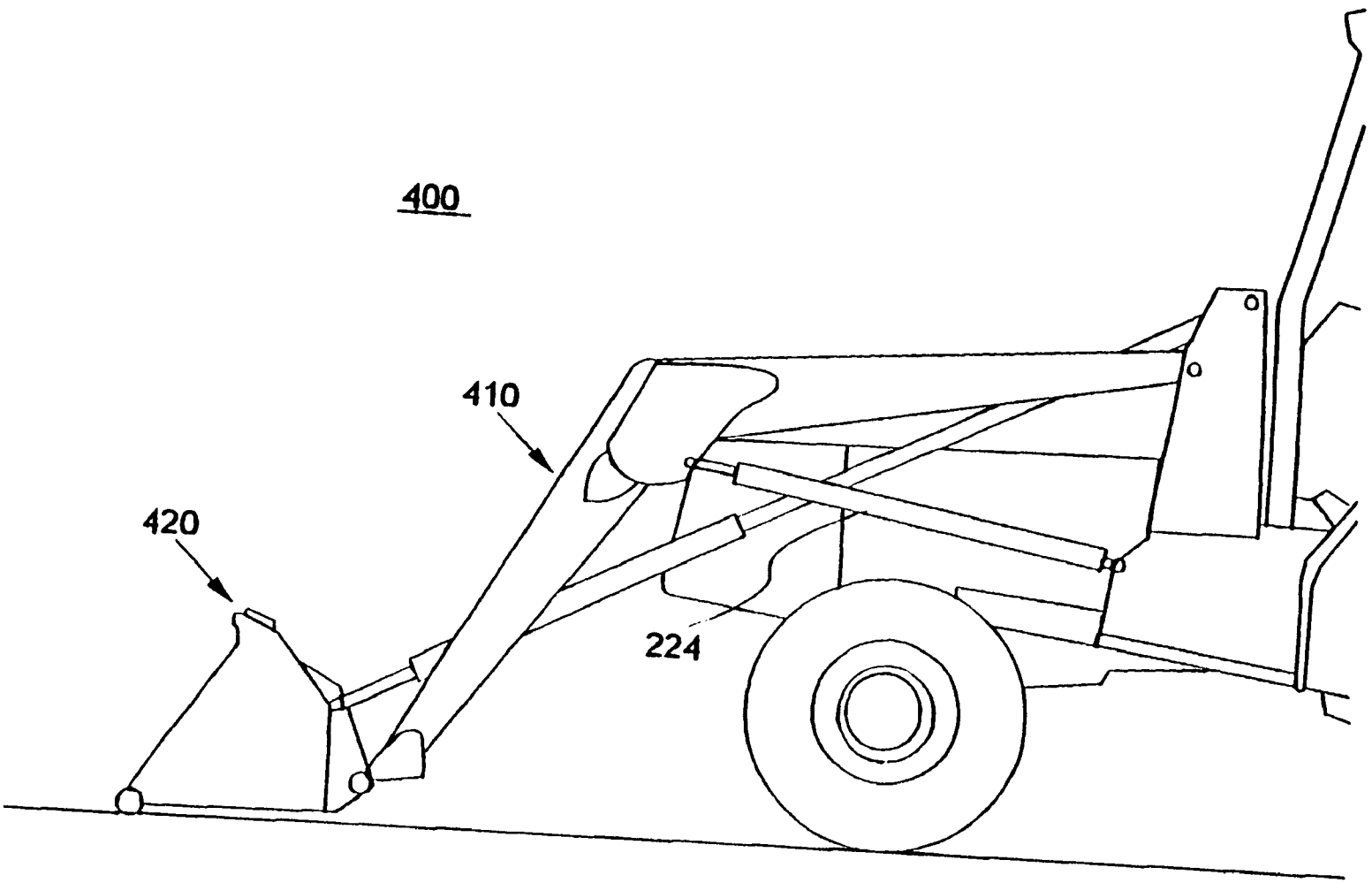
FIG. 3 depicts an earth working machine incorporating an embodiment of the present invention.

The following detailed description of the invention will describe one application of the preferred embodiment of the preferred use on an earth working machine 400, FIG. 3, such as a backhoe loader or a wheel loader, to which is attached a load manipulator. The load manipulator may be an implement such as a bucket, rake, grapple, clamshell, or other material handling apparatus.

Figure 1:
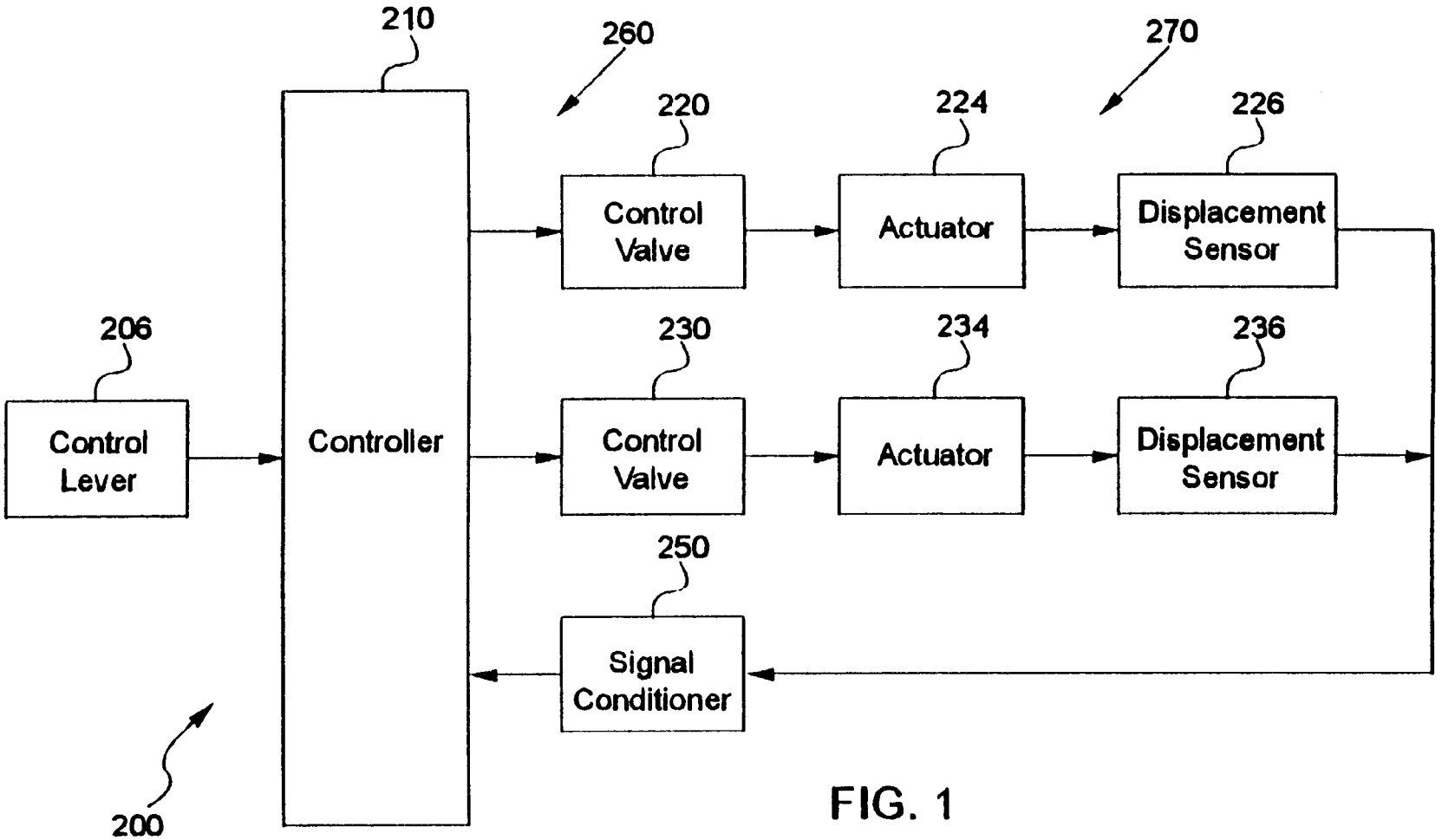
FIG. 1 depicts a schematic diagram utilizing two valves and two actuators to reduce frame stress in accordance with a preferred embodiment of the present invention.

Referring to FIG. 1, a block diagram of a machine control system 200 in accordance with the present invention is shown. The control system 200 provides automatic control of the first and second actuators 224, 234. Preferably, the control system 200 includes a microprocessor-based controller 210. A fluid operated control system 260 includes first and second control valves 220, 230 which control the flow of fluid to first and second actuators 224, 234. The controller 210 includes an input device which is adapted to sense a plurality of inputs and responsively produce output signals which-are delivered via an output device to the first and second control valves 220, 230 of the control system 200.

A control input device or control lever 206 is provided for the operator to manually control the movement of the working implement e.g., a bucket. Preferably, the control lever 206 (e.g., a joystick) is pivotally movable to a plurality of different positions. The control lever 206 delivers a command signal to the controller 210 in response to a pivotal position of the control lever 206. In response to receiving the command signal, the controller 210 produces a control signal which is delivered by a driver circuit of any commercially available type to effect actuation of the first and second control valves 220, 230 to raise or lower the implement.

In addition to the aforementioned manual control of the implement, semi-automatic control over the implement is discussed below.

Figure 2:
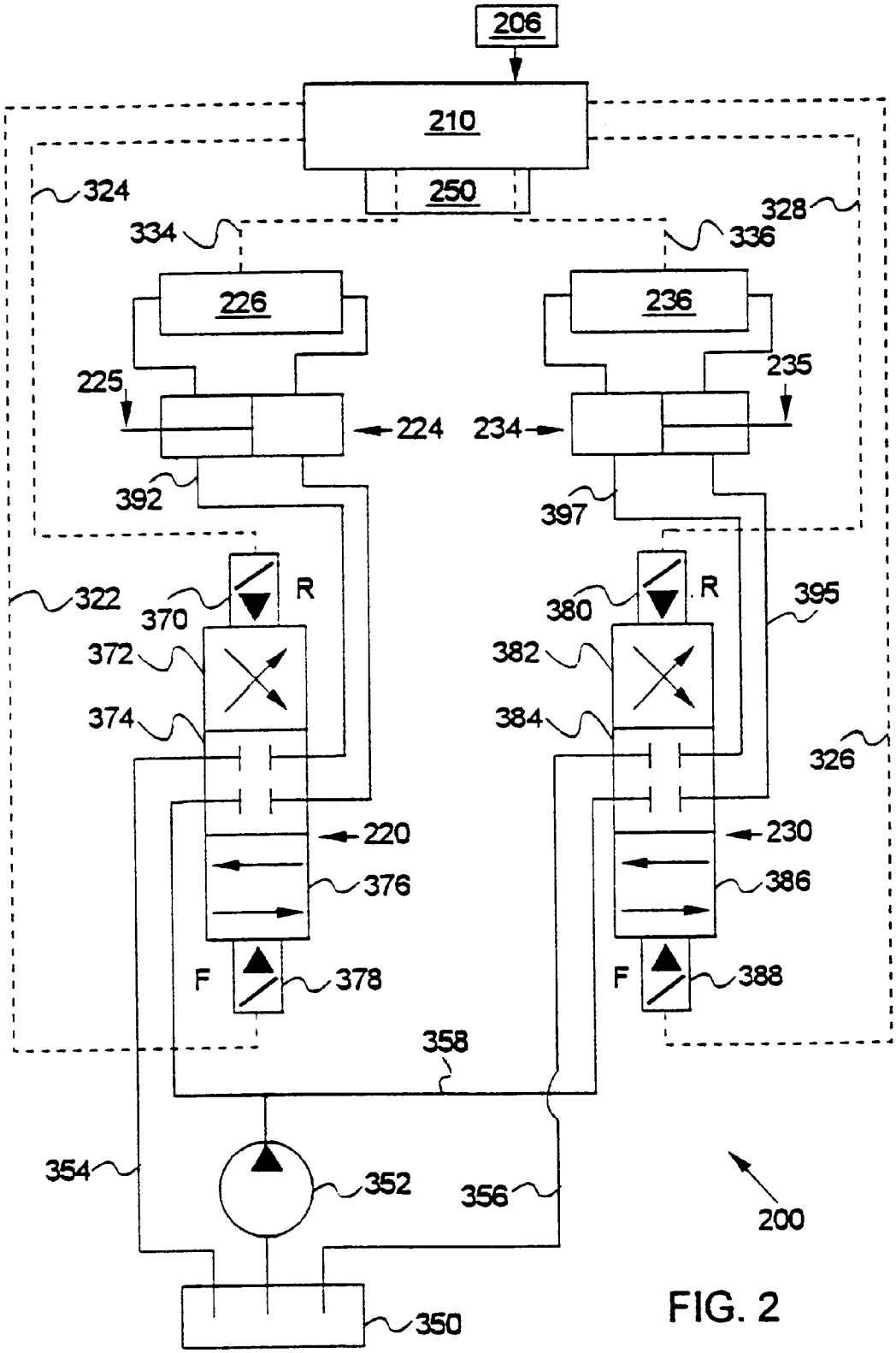
FIG. 2 depicts a diagrammatic representation of an embodiment of the control system of the present invention.

Displacement sensing means 270 produces position signals in response to the relative positions of the extensible first and second lift actuator pistons 225, 235 of the first and second lift actuators 224, 234, respectively (refer to FIG. 2). More particularly, the displacement sensing means 270 includes first and second displacement sensors 226, 236 that sense the amount of actuator piston 225, 235 extension of the first and second actuators 224, 234, and responsively produce first and second signals in response to the respective actuator piston 225, 235 extension. The first and second displacement sensors 226, 236 each preferably include a magnetostrictive sensor (not shown) of a type well known in the art. A magnetostrictive sensor is a magnetic position responsive device which generates a pulse width modulated (PWM) signal. In the particular application disclosed herein, the PWM position signals generated by the first and second displacement sensors 226, 236 are proportional to the relative extension of the first and second actuator pistons 225, 235. It should be noted that other well known devices, for example, a linear variable differential transformer, yo-yo type encoder, potentiometer, or resolver, and an RF signal generator are suitable substitutes for the magnetostrictive sensor and within scope of the invention.

The PWM displacement signals are delivered to the controller 210 via a signal conditioner circuit 250 which converts the PWM signals into digital signals for further processing. Such signal conditioner circuits are well known in the art. Further note that the signal conditioner circuit 250 may be part of the controller 210 and may be implemented in software therein.

In an alternative embodiment of the invention, strain gauges may be affixed to the loader frame at such locations as are appropriate to detect twisting of the frame. The twisting force, when applied to the frame, will cause the strain gauges to produce an output proportional to the amount of twisting force or torque to which the frame is subjected. The strain gauge signals are delivered to the controller 210 via a signal conditioning circuit 250 as discussed above in relation to the PWM signals.

The controller 210 may include any appropriate processor suitable for processing the position signals in accordance with preprogrammed instructions and a memory for storing instructions, information, and processed information.

The controller 210 includes a comparator system which determines the magnitude of the difference between the relative displacements of the first and second actuator pistons 225, 235, based on the first and second displacement signals. This difference indicates the amount of unequal travel between the first and second actuator pistons 225, 235. The difference is then compared to a predetermined maximum amount, and if the value of the difference is greater than this tolerable amount, a signal is given to a valve actuator 370, 378, 380, 388 (FIG. 2) to produce the necessary control valve 220, 230 operation which will move a actuator piston 225, 235 in the appropriate direction.

A fluid reservoir 350 provides a supply of fluid for the fluid operated machine control system 200. A pump 352 supplies pressurized fluid to first and second control valves 220, 230 via fluid conduits 358. The first and second control valves 220, 230 are of the four-port, three-position (i.e., a 4-3 valve) type in this particular embodiment, but other suitable valve types may be employed.

Coupled to the first control valve 220 are first control valve forward and reverse actuators 370, 378, respectively. Similarly, coupled to the second control valve 230 are second control valve forward and reverse actuators 380, 388, respectively. The terms "forward" and "reverse" are used solely for purposes of clarity, regarding extend and retract movements of the first and second actuator pistons 225, 235, and are meant to be relative terms only.

The output ports of the first and second control valves 220, 230 are coupled to the first and second lift actuators 224, 234, respectively, by supply lines 390, 395 and return lines 392, 397. The first and second lift actuators 224, 234 are in turn operationally connected to the machine frame (not shown) to which a working implement (e.g., a bucket) is attached. Thus, the first and second actuators 224, 234 provide the motive means for the machine frame.

A first displacement sensor 226 is operationally coupled to the first actuator piston 225. As discussed above, the first displacement sensor 226 senses the amount of extension of the first actuator piston 225 and responsively produces a signal in response to this amount. This signal is transmitted to signal conditioner 250 and controller 210 via first displacement sensor output signal line 334.

In a similar manner, a second displacement sensor 236 is operationally coupled to the second actuator piston 235. As discussed above, the second displacement sensor 236 senses the amount of extension of the second actuator piston 235 and responsively produces a signal in response to this amount. This signal is transmitted to signal conditioner 250 and controller 210 via second displacement sensor output signal line 336.

The operation of the first and second control valves 220, 230 is as follows. In response to a command from the machine operator via control lever 206, the controller 210 sends signals to the first and second control valve forward actuators 378, 388 via signal lines 322, 326. These actuators 378, 388 close their respective first and second control valve ports 374, 384 in the forward configuration 376, 386. Thus, supply lines 390, 395 and return lines 392, 397 are established to each of the first and second actuators 224, 234. The first and second actuator pistons 225, 235 are then extended, causing the frame and implement to rise.

During a frame lift movement, the invention operates as follows. As the first and second actuator pistons 225, 235 are extended, the outputs of the first and second displacement sensors 226, 236 are monitored by the control unit 210. The controller 210 monitors the difference between the relative displacements of the first and second actuator pistons 225, 235, as discussed above. When corrective action is required due to excessive unequal travel of the first and second actuator pistons 225, 235, signals are sent to the appropriate valve actuator 370, 378, 380, 388.

In response to a frame lower command from the machine operator via control lever 206, the controller 210 sends signals to the first and second control valve reverse actuators 370, 380 via signal lines 324, 328. These actuators 370, 380 close their respective first and second control valve ports 374, 384 in the reverse configuration 372, 382. Thus, supply lines 390, 395 and return lines 392, 397 are reversed to each of the first and second actuators 224, 234. The first and second actuator pistons 225, 235 are then retracted, causing the frame and implement to lower.

The operation of the invention during a frame lower movement parallels that of the frame lift movement.

Industrial Applicability

With reference to the drawings, and in operation, the operator may manually control lifting of the implement by way of the control lever 206 as discussed above. Further, the present invention provides for a semi-automatic control by limiting the degree of imbalance between the actuators 224, 234. Thus, the operator may freely command the implement to move without the worry that the force provided by the actuators 224, 234 will become so unbalanced as to twist the frame and cause substantial damage to the machine.

Other aspects and features of the present invention can be obtained from a study of the drawings, the disclosure, and the appended claims.

I claim:

1. A controller for load manipulation of a device by a first actuator and a second actuator, said controller comprising:

an input device for receiving a first displacement signal and a second displacement signal, said first displacement signal from a first displacement sensor, said first displacement sensor operationally attached to said first actuator, and said second displacement signal from a second displacement sensor, said second displacement sensor operationally attached to said second actuator;

a comparator for comparing the first displacement signal and the second displacement signal to determine a maximum differential value; and an output device for providing a signal to adjust the first and second actuator to be within a predetermined range for the maximum differential value, thereby preventing damage to the device.

2. The controller of claim 1, further comprising: a control lever being pivotally movable to a plurality of positions, the control lever producing a frame lift command signal in response to a position of the control lever.

3. The controller of claim 1, wherein the first and second displacement sensors each include a magnetostrictive device being connected to each of the first and second actuators.

4. A control system comprising:

at least two lift actuators;

a control valve, operatively connected to each of said lift actuators;

a displacement sensor, operatively connected to each of said actuators to determine the amount of travel of the pistons of said actuators; and a controller for comparing outputs from the displacement sensors and for operating said control valves to adjust the amount of travel of said pistons in response to the outputs of the displacement sensors.

5. The control system of claim 4, wherein the controller for comparing outputs from the displacement sensors further comprises electronics.

6. The control system of claim 4, wherein the controller for comparing outputs from the displacement sensors comprises a computer.

7. The control system of claim 4, wherein each of the actuator control valves is a four-port, three-position valve.

8. A control method for an implement attached to a frame on an earth working machine with first and second fluid operated actuators being operatively connected to the frame, and first and second control valves being adapted to deliver pressurized fluid to the actuators, comprising the steps of:

producing an implement move command signal in response to a position of a control lever;

receiving the implement move command signal and responsively delivering an implement move control signal to the first and second valves to cause pressurized fluid flow to actuate the first and second actuators to move the implement;

producing a first position signal indicative of the extension of the first actuator;

producing a second position signal indicative of the extension of the second actuator; and receiving the first and second position signals, determining a magnitude of the difference between the relative positions of the first and second actuators, comparing the magnitude difference to a maximum differential value, and stopping the delivery of the implement move control signal in response to the magnitude difference being substantially equal to the maximum differential value, the maximum differential value representing the maximum imbalance that the frame can withstand without damage.

9. A control method as set forth in claim 8, including the steps of reducing the magnitude of the implement move control signal as the magnitude difference approaches a predetermined range of the maximum differential value.

10. A method of controlling loader lift cylinders comprising:

providing a machine control system operatively coupled to the lift cylinders, wherein the machine control system includes means for determining the amount of extension of each of the lift cylinders;

comparing the amount of extension of each lift cylinder against a maximum differential value; and adjusting the amount of extension of each lift cylinder in response to the amount of extension that is detected beyond the maximum differential value.

11. The method of claim 10, wherein the amount of extension of each lift cylinder is adjusted to be substantially equal.

12. The method of claim 10, wherein the means for determining the amount of extension of each of the lift cylinders further comprises a position sensor.

13. The method of claim 10, wherein the means for comparing the amount of extension of each lift cylinder further comprises electronic means.

14. The method of claim 10, wherein the means for comparing the amount of extension of each lift cylinder further comprises a computer.

* * * * *